US005311842A

United States Patent [19]

Nagato et al.

[11] Patent Number: 5,311,842

[45] Date of Patent: May 17, 1994

[54] FLUIDIZED BED WATER PIPE BOILER DIVIDED TYPE

[75] Inventors: Shuichi Nagato; Takahiro Ohshita; Masaji Kamisada, all of Kanagawa; Norihisa Miyoshi, Chiba; Hiroshi Ishibe, Kanagawa, all of Japan

[73] Assignee: Ebara Corporation, Tokyo, Japan

[21] Appl. No.: 46,871

[22] Filed: Apr. 16, 1993

[30] Foreign Application Priority Data

Apr. 17, 1992 [JP] Japan ..... 4-122845
Jul. 31, 1992 [JP] Japan ..... 4-223509

[51] Int. Cl.[5] ..... F22B 1/00

[52] U.S. Cl. ..... 122/4 D; 29/890.03; 122/510; 165/104.16

[58] Field of Search ..... 122/4 D, 510; 29/890.03; 165/104.16

[56] References Cited

U.S. PATENT DOCUMENTS 3,763,830 10/1973 Robinson et al. ..... 122/4 D
3,970,011 7/1976 Virr et al. .
4,424,766 1/1984 Boyle ..... 122/4 D
4,510,892 4/1985 Wincze et al. .
4,528,945 7/1985 Virr et al. .
4,604,972 8/1986 Difonzo et al. ..... 122/510
4,641,608 2/1987 Waryasz .
4,947,803 8/1990 Zenz ..... 122/4 D
5,033,413 7/1991 Zenz et al. ..... 122/4 D
5,094,191 3/1992 Garkawe et al. .
5,156,099 10/1992 Ohshita et al. .

FOREIGN PATENT DOCUMENTS 0129486 12/1984 European Pat. Off. .
0147275 8/1985 European Pat. Off. .
0253112 1/1988 European Pat. Off. .
3638766 5/1988 Fed. Rep. of Germany .
63-63804 12/1988 Japan .
4-198604 7/1992 Japan .

*Primary Examiner*—Edward G. Favors
*Attorney, Agent, or Firm*—Wenderoth, Lind & Ponack

[57] ABSTRACT

A fluidized bed water tube boiler comprising a fluidized bed combustion section including a fluidized bed formed from a continuous water tube wall, a free-board section for burning volatile components produced in the fluidized bed combustion section, and a convective heat transfer section comprised of a steam drum and a water drum connected to the downstream side of the free-board section through water tubes for recovering heat from combustion exhaust gas; wherein the fluidized bed combustion section and the freeboard section are formed as separable modules which are connected to each other, and circulation of a boiler water between the fluidized bed combustion section and the convective heat transfer section is separated from that between the freeboard section and the convective heat transfer section.

21 Claims, 8 Drawing Sheets

Fig. 8 -PRIOR ART
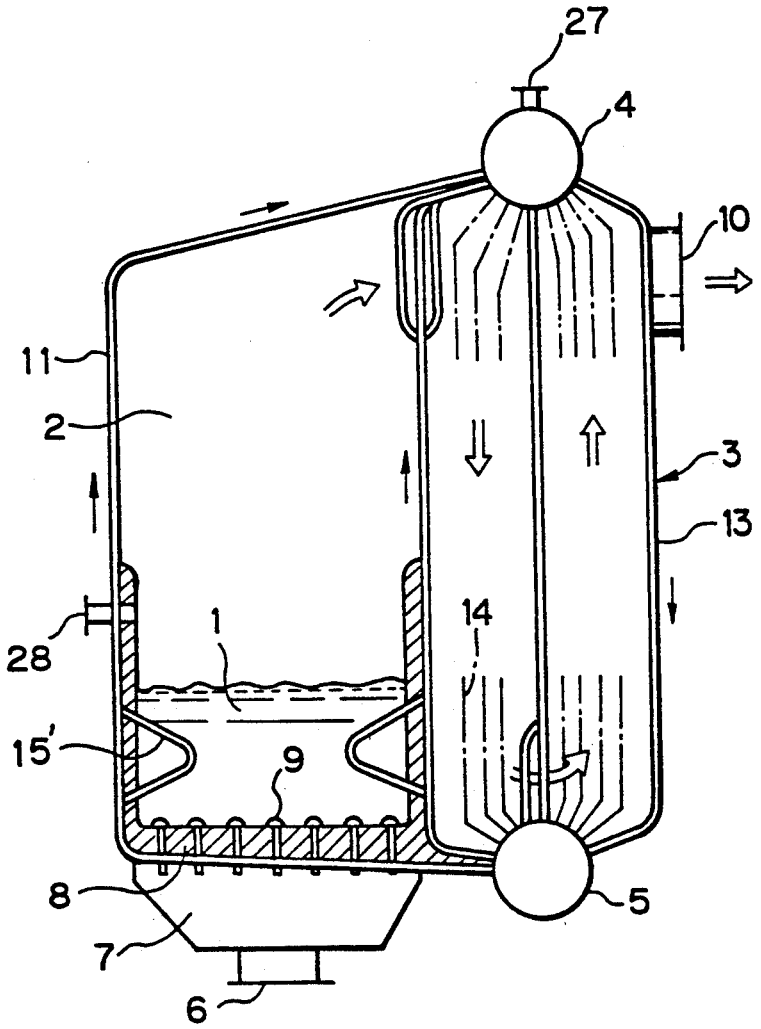

FLUIDIZED BED WATER PIPE BOILER DIVIDED TYPE

BACKGROUND OF THE INVENTION

1. Field of the Art

The present invention relates to a fluidized bed boiler, and more particularly to a fluidized bed water tube boiler in which at least a fluidized bed wall is constituted of water tubes.

2. Prior Art

A fluidized bed water tube boiler comprises a fluidized bed combustion section, a freeboard section and a convective heat transfer section. First, a conventional fluidized bed water tube boiler will be described with reference to FIG. 8.

In FIG. 8, a fluidized bed water tube boiler comprises a fluidized bed combustion section 1 and a freeboard section 2 which are formed from a common water tube wall 11. Combustion gas generated in the fluidized bed combustion section 1 passes through the freeboard section 2 and is then introduced to a convective heat transfer section 3 provided in the boiler, and is then discharged to the outside through an exhaust gas outlet 10 after being subjected to heat exchange.

Boiler water is led out of a water drum 5, rises in the common water tube wall 11, and further enters a steam drum 4. In the convective heat transfer section 3, the boiler water moves down through tubes in a rear wall 13 of the convective heat transfer section to enter the water drum 5 and, thereafter, moves up through heat transfer tubes 14 in the convective heat transfer section while being heated, and returns to the steam drum 4. Thus, the fluidized bed water tube boiler is constituted such that the steam drum, the water drum and the water tubes cooperate to circulate the boiler water. The generated steam is taken out through a steam outlet 27.

In the operation of the fluidized bed water tube boiler shown in FIG. 8, fluidizing air is introduced into an air plenum 7 through a fluidizing air inlet 6. Then, the air is blown at 3–12 Uo/Umf into the fluidized bed combustion section through fluidizing air dispersion nozzles 9 provided at the furnace bottom, so that a fluidizing medium in the fluidized bed combustion section is fluidized. Fuel is supplied through a fuel supply port 28 in the heated fluidizing medium.

While the fuel is burnt in the fluidized bed combustion section, fuel powder not yet burnt and exiting the fluidized bed, as well as combustible volatile components produced by being heated in the fluidized bed are further burnt with secondary air supplied to the freeboard section. Exhaust gas is discharged from an upper portion of the freeboard section in the direction of an arrow (→) and is then introduced to the convective heat transfer section 3 from its upper portion, and is discharged to the outside through the exhaust gas outlet 10 after heating the boiler water in the convective heat transfer section 14.

Incidentally, in FIG. 8, reference numeral 8 denotes a refractory material for protecting the inner combustion surface of the fluidized bed and 15' denotes a heat transfer tube in the fluidized bed formed by bending the water tube.

Meanwhile, there are known various types of fluidized bed water tube boilers wherein the fluidized bed is of a swirling type, or wherein an inclined partition wall is provided in the swirling fluidized bed to define a heat recovery chamber between a rear surface of the inclined partition wall and a furnace wall.

Since a combustion rate and other factors differ depending on the kinds of fuel and materials to be burnt, boilers are generally designed to be adapted for the kind of fuel and combustibles used. In particular, since a freeboard has an important role, its volume and configuration are made to different specifications depending on the use.

Accordingly, it is difficult to change the fuel once a furnace is in operation. In the case of burning industrial waste, there is a problem that the properties of exhaust gas deteriorate with changes in the nature of waste to be burnt.

Fluidized bed boilers are designed to be adaptable for various kinds of fuel, and can be used to burn a wide range of materials such as low-grade coal and industrial waste. However, such an advantage of fluidized bed boilers has not yet been fully utilized for the reason mentioned above.

Further, since designs depend on the fuel used, it has been difficult to produce a standardized design even for medium- and small-sized fluidized bed boilers.

The foregoing problems are basically attributable to the nature of the water tube boiler itself. More specifically, water tube boilers are superior both in terms of structure and function, and most boilers used today for industrial or utility purposes are water tube boilers.

With respect to the design of water tube boilers, it is important to ensure proper circulation of boiler water through the water tube wall and the heat transfer tubes. Thus, the boiler's configuration and structure are determined with a view thereto, and to the nature of a fuel to be used and the level of combustion which is expected.

Accordingly, if it is attempted to change fuel after a furnace is in use, a deterioration in combustion and in the properties of an exhaust gas generally result. It is difficult and costly to change the freeboard structure of a boiler to solve such a problem, since the water tubes themselves are an integral part of the boiler and function as a pressure part. Furthermore, water circulation must be maintained at an adequate level after any such reconstruction.

Although a fluidized bed water tube boiler is often utilized to burn solid fuel such as coal, it has a smaller furnace load than heavy oil boilers or gas-fueled boilers, and requires a lower flow velocity in the convective heat transfer section to overcome the problem of dust in exhaust gas. This necessarily leads to an increase in size of the fluidized bed combustion section, the freeboard section and the convective heat transfer section. Thus, even a boiler with a steam level of 10–20 T/H, it must be assembled on site due to the transport limitations.

On the other hand, heavy oil boilers or gas-fueled boilers even in the class of 10–20 T/H can be manufactured in a factory and transported as a completed product to a site with no need for further assemblance. Accordingly, those boilers are superior to fluidized bed water tube boilers from standpoints of cost and construction efficiency. Consequently, fluidized bed water tube boilers have not generally been used for burning coal.

SUMMARY OF THE INVENTION

The present invention was made to solve the problems of the prior art stated above. To this end, in brief, the present invention is constituted by forming a fluidized bed combustion section, a freeboard section and, if desired, a convective heat transfer section in a separable and dividable manner. It is designed to circulate water in a convective heat transfer section, between the convective heat transfer section and water tubes in a fluidized bed combustion section, and between the convective heat transfer section and water tubes in the freeboard section independently of one another. More specifically, the present invention consists of the following fifteen inventions (1) to (15).

(1) A fluidized bed water tubes boiler comprising a fluidized bed combustion section including a fluidized bed formed from a continuous water tube wall, a freeboard section for burning volatile components produced in said fluidized bed combustion section, and a convective heat transfer section comprised of a steam drum and a water drum connected to the downstream side of said freeboard section through water tubes for recovering heat from combustion exhaust gas; said boiler being characterized in that said fluidized bed combustion section and said freeboard section are formed as separable modules which are connected to each other, and circulation of a boiler water between said fluidized bed combustion section and said convective heat transfer section is separated from that between said freeboard section and said convective heat transfer section.

(2) A fluidized bed water tube boiler described in (1), wherein two collective headers comprising a freeboard section lower header and a fluidized bed combustion section upper header are provided so as to surround said water tube wall near the boundary between said fluidized bed combustion section and said freeboard section, said fluidized bed combustion section and said freeboard section being separable between said two headers, and said fluidized bed combustion section module is constituted such that said fluidized bed combustion section upper header and a fluidized bed combustion section lower header provided so as to surround a lower portion of said fluidized bed are communicated with each other by a group of water tubes to form said wall of said fluidized bed combustion section.

(3) A fluidized bed water tube boiler comprising a fluidized bed combustion section including a fluidized bed formed from a continuous water tube wall, a freeboard section for burning volatile components produced in said fluidized bed combustion section, and a convective heat transfer section including a steam drum and a water drum connected to the downstream side of said freeboard section through water tubes for recovering heat from combustion exhaust gas; said boiler being characterized in that two collective headers comprising a freeboard section lower header and a fluidized bed combustion section upper header are provided so as to surround said water tube wall near the boundary between said fluidized bed combustion section and said freeboard section, said fluidized bed combustion section and said freeboard section being separable between said two headers, said fluidized bed combustion section is formed as a module which is constituted such that said fluidized bed combustion section upper header and a fluidized bed combustion section lower header provided so as to surround a lower portion of said fluidized bed are communicated with each other by a group of water tubes to form said wall of said fluidized bed combustion section, said freeboard section is formed as a module which is constituted such that said freeboard section lower header and a freeboard section upper header provided in an upper portion of said freeboard section are communicated with each other by a group of water tubes to form a wall of said freeboard section, and said freeboard section is separable from said convective heat transfer section, whereby said boiler is divided into three modules of said fluidized bed combustion section, said freeboard section and said convective heat transfer section.

(4) A fluidized bed water tube boiler described in (3), wherein said freeboard section can be separated from said convective heat transfer section at a flue connecting said freeboard section and said convective heat transfer section.

(5) A fluidized bed water tube boiler described in (3), wherein said convective heat transfer section module is formed from a boiler of natural circulation type wherein said steam drum and said water drum are interconnected by water tubes.

(6) A fluidized bed water tube boiler described in (5), wherein said steam drum and said water drum are connectable to said fluidized bed combustion section upper header and said fluidized bed combustion section lower header by a fluidized bed combustion section ascending pipe and a fluidized bed combustion section water descending pipe, respectively, and said steam drum and a lower portion of said steam drum or said water drum are connectable to said freeboard section upper header and said freeboard section lower header by a freeboard section ascending pipe and a freeboard section water descending pipe, respectively.

(7) A fluidized bed water tube boiler comprising three divided modules including a fluidized bed combustion section module forming a fluidized bed, a freeboard section module for burning volatile components produced in said fluidized bed, and a convective heat transfer section module for recovering heat from combustion gas; said boiler being characterized in that said fluidized bed combustion section module is constituted such that a fluidized bed combustion section upper header and a fluidized bed combustion section lower header provided so as to surround upper and lower portions of said fluidized bed combustion section, respectively, are communicated with each other by a group of water tubes, said group of water tubes forming a wall of said fluidized bed combustion section, and said freeboard section module is formed from steel plates, a refractory material and a heat insulating material for maintaining a high temperature in said freeboard section.

(8) A fluidized bed water tube boiler described in (7), wherein said convective heat transfer section module is formed from a boiler of a natural circulation type wherein a steam drum and a water drum are interconnected by water tubes.

(9) A fluidized bed water tube boiler described in (8), wherein said steam drum and a lower portion of said steam drum or said water drum are connectable to said fluidized bed combustion section upper header and said fluidized bed combustion section lower header by an ascending pipe and a descending pipe, respectively.

(10) A fluidized bed water tube boiler comprising three divided modules including a fluidized bed combustion section module comprised of a main fluidizing chamber forming a main fluidized bed to burn solid substances and a heat recovery chamber forming a heat recovery bed to recover heat from said main fluidized bed, a freeboard section module for burning volatile components produced in said main fluidized bed, and a convective heat transfer section module for recovering heat from combustion gas; said boiler being characterized in that said fluidized bed combustion section module is constituted by an upper header, a lower header and a water tube wall interconnecting both said headers, each header having the square form, and those water tubes of said water tube wall which are positioned in the left and right sides as viewed from the front of said boiler are constituted by groups of water tube alternately protruding inwardly to greater and lesser extents respectively, said former group of water tubes being protected at their lower surfaces by a refractory material to define said main fluidizing chamber and said heat recovery chamber and also serving as a deflector adapted to change a fluidizing direction of a heat medium in said main fluidized bed, and said latter group of water tubes serving as heat recovery chamber in-bed heat transfer tubes of natural circulation type to recover heat from said heat recovery bed.

(11) A fluidized bed water tube boiler described in (10), wherein said freeboard section module is formed from steel plates, a refractory material and a heat insulating material for maintaining a high temperature in said freeboard section.

(12) A fluidized bed water tube boiler described in (10), wherein said convective heat transfer section module is formed from a boiler of a natural circulation type comprising a steam drum, a water drum and water tubes, said steam drum and said water drum being connectable to an upper header and a lower header of said fluidized bed combustion section module by an ascending pipe and a descending pipe, respectively.

(13) A fluidized bed water tube boiler described in (7) or (10), wherein said freeboard section has a horizontal dividing plane provided in its intermediate portion and can be joined to another freeboard unit at said intermediate horizontal dividing plane.

(14) A fluidized bed water tube boiler described in (10), wherein said fluidized bed combustion section module is constituted such that aside from said water tube wall, said group of heat recovery chamber in-bed heat transfer tubes are grouped into a plurality of independent units each connected to an upper header and a lower header, said units being inserted into said heat recovery bed from a lateral surface of said fluidized bed combustion section, and said upper and lower headers of each of said units are respectively connected to said upper and lower headers of said fluidized bed combustion section module through tubes to thereby constitute said heat recovery chamber in-bed heat transfer tubes of a natural circulation type, said units being detachably attached to said fluidized bed combustion section module.

(15) A fluidized bed water tube boiler described in any one of (10) to (14), wherein for returning fly ash or the like captured in said convective heat transfer section module to said fluidized bed combustion section module, transport equipment is provided below said convective heat transfer section module and has its distal end coupled to said fluidized bed combustion section module.

Since the present invention is arranged as above, the present invention effects the water circulation not through an entire fluidized bed boiler, but rather locally between the fluidized bed combustion section and the convective heat transfer section, and between the freeboard section and the convective heat transfer section independently of one another, thus making it possible to divide the fluidized bed combustion section, the freeboard section and if desired the convective heat transfer section into separate units. As a result, those sections can be individually designed and manufactured as separate modules which can be used in various combinations depending on the nature of the material to be burnt. In addition, the freeboard section module can be replaced by another one in accordance with a change in the material to be burnt even after the furnace has commenced operation.

It is also possible to form the freeboard section module from a steel plate, a refractory material and a heat insulating material. This enables the production of a higher temperature in the freeboard section which contributes to a reduction in CO, $N_2O$ and dioxin emissions. Also, due to the absence of a water tube structure, the freeboard section can be designed with a view to improving combustion capability and exhaust gas emissions without the need to take water circulation into account.

Moreover, with the fluidized bed boiler functionally divided into two or more modules, each of the modules can be manufactured in a factory and transported to a site. Unlike the prior art, therefore, even a fluidized bed boiler with a steam level of 10–20 T/H can be constructed by merely connecting the modules to each other at the site. This enables construction, operations to the simplified and in costs and time taken for construction to be reduced. Thus, separation into modules can overcome the abovementioned drawbacks in the conventional fluidized bed water tube boiler by facilitating standardization of design and reducing manufacturing costs.

The above and other objects, features and advantages of the present invention will become more apparent from the following description when taken in conjunction with the accompanying drawings in which preferred embodiments of the present invention are shown by way of illustrative examples.

BRIEF DESCRIPTION OF THE DRAWINGS

FIG. 8 is a vertical sectional view of one example of a fluidized bed water tube boiler in the prior art.

PREFERRED EMBODIMENTS OF THE INVENTION

Hereinafter, the present invention will be described in detail with reference to the drawings.

Figure 1:
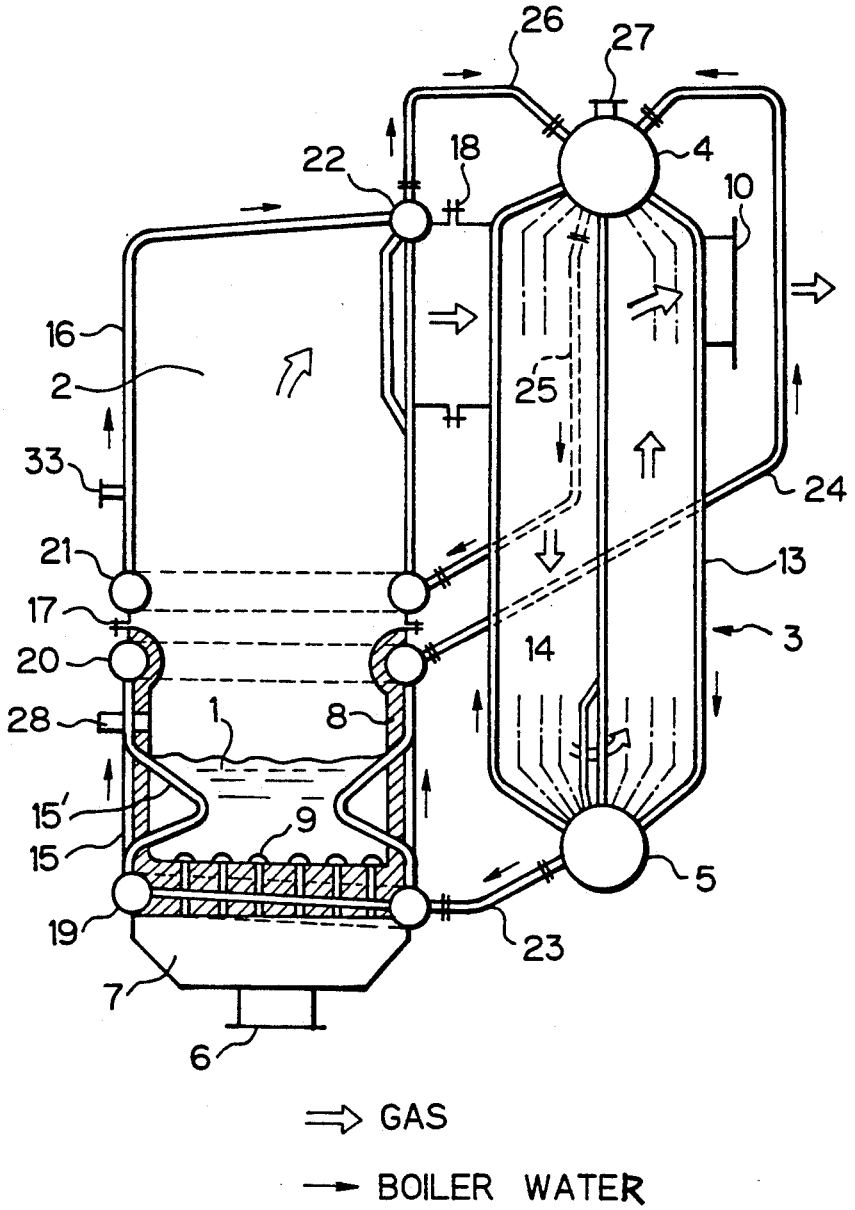
FIG. 1 is a vertical sectional view showing one embodiment of a fluidized bed water tube boiler of the present invention.

In a fluidized bed water tube boiler shown in FIG. 1, between a fluidized bed combustion section 1 and a freeboard section 2, there are provided a freeboard section lower header 21 and a fluidized bed combustion section upper header 20 each having the square form in a plan view, whereby the freeboard section 2 and the fluidized bed combustion section 1 are made independently of each other. Both the headers are interconnected by bolt coupling at joint flanges 17.

An exhaust gas introducing duct, through which combustion exhaust gas is introduced from the freeboard section 2 to a convective heat transfer section 3, is connected by bolt coupling at joint flanges 18 so that the freeboard section 2 and the convective heat transfer section 3 are separable from each other.

On the other hand, a freeboard section upper header 22 is provided at an upper end of the freeboard section, and this upper header 22 and the aforesaid freeboard section lower header 21 are interconnected by a group of water tubes to constitute a freeboard section water tube wall 16. The freeboard section lower header 21 is connected to a lower portion of a steam drum 4 in the convective heat transfer section by a freeboard section water descending pipe 25 or, though not shown, to a water drum 5 by a water descending pipe when the freeboard section lower header 21 exists at a position lower than the water drum 5, while the freeboard section upper header 22 is connected to the steam drum 4 by freeboard section ascending pipe 26, thereby enabling boiler water to circulate between the freeboard section water tube wall 16 and the convective heat transfer section 3.

Note that the freeboard section upper header 22 may be provided so as to surround an upper portion of the freeboard section similarly to the lower header 21.

Further, the fluidized bed combustion section upper header 20 is connected to a fluidized bed combustion section lower header 19, which is provided in a lower portion of the fluidized bed combustion section so as to surround the same, by a group of water tubes constituting a water tube wall 15 of the fluidized bed combustion section. Additionally, the fluidized bed combustion section upper header 20 is connected to the steam drum 4 by a fluidized bed combustion section ascending pipe 24 and the fluidized bed combustion section lower header 19 is connected to the water drum 5 by a fluidized bed combustion section water descending pipe 23, so that the boiler water can circulate between the group of water tubes constituting the water tube wall 15 of the fluidized bed combustion section and the convective heat transfer section 3.

Though not shown, the fluidized bed combustion section lower header 19 may be connected to a lower portion of the steam drum 5 by a descending water pipe.

The freeboard section water descending pipe 25, the freeboard section ascending pipe 26, the fluidized bed combustion section descending water pipe 23, and the fluidized bed combustion section ascending pipe 24 are connected by bolt coupling at respective flanges in a removable manner.

A description will be next given of flows of the boiler water in the fluidized bed combustion section and the freeboard section.

In the fluidized bed combustion section 1, the boiler water is introduced from the water drum 5 to the fluidized bed combustion section lower header 19 through the fluidized bed combustion section descending pipe 23, then rises through the fluidized bed combustion section water tube wall 15 and in-bed heat transfer tubes 15', while being heated, to be collected together in the fluidized bed combustion section upper header 20, and is further delivered to the steam drum 4 through the fluidized bed combustion section ascending pipe 24.

In the freeboard section 2, the boiler water is introduced to the freeboard section lower header 21 through the freeboard section descending water pipe 25, then rises through the water tubes of the freeboard section water tube wall 16, while being heated, to be collected together in the freeboard section upper header 22, and is further circulated to the steam drum 4 through the freeboard section ascending pipe 26.

In the convective heat transfer section 3, as with the prior art, the boiler water moves down toward the water drum 5 through tubes in the rear wall 13 of the convective heat transfer section and then rises through convective heat transfer tubes 14 while being heated, and is circulated to the steam drum 4.

As described above, the circulation of the boiler water between the fluidized bed combustion section 1 and the convective heat transfer section 3, the circulation of the boiler water between the freeboard section 2 and the convective heat transfer section 3, as well as the circulation of the boiler water in the convective heat transfer section 3 are effected independently of one another. Thus, for example, if the freeboard section 2 is replaced with a substitute formed of a heat insulating material without using a water tube wall, the circulation of the boiler water between the fluidized bed combustion section 1 and the convective heat transfer section 3 and the circulation of the boiler water in the convective heat transfer section 3 will not be affected.

Incidentally, reference numeral 33 denotes a secondary air supply port.

Next, a fluidized bed water tube boiler with a freeboard wall formed of a heat insulating material will be explained with reference to FIG. 2.

Figure 2:
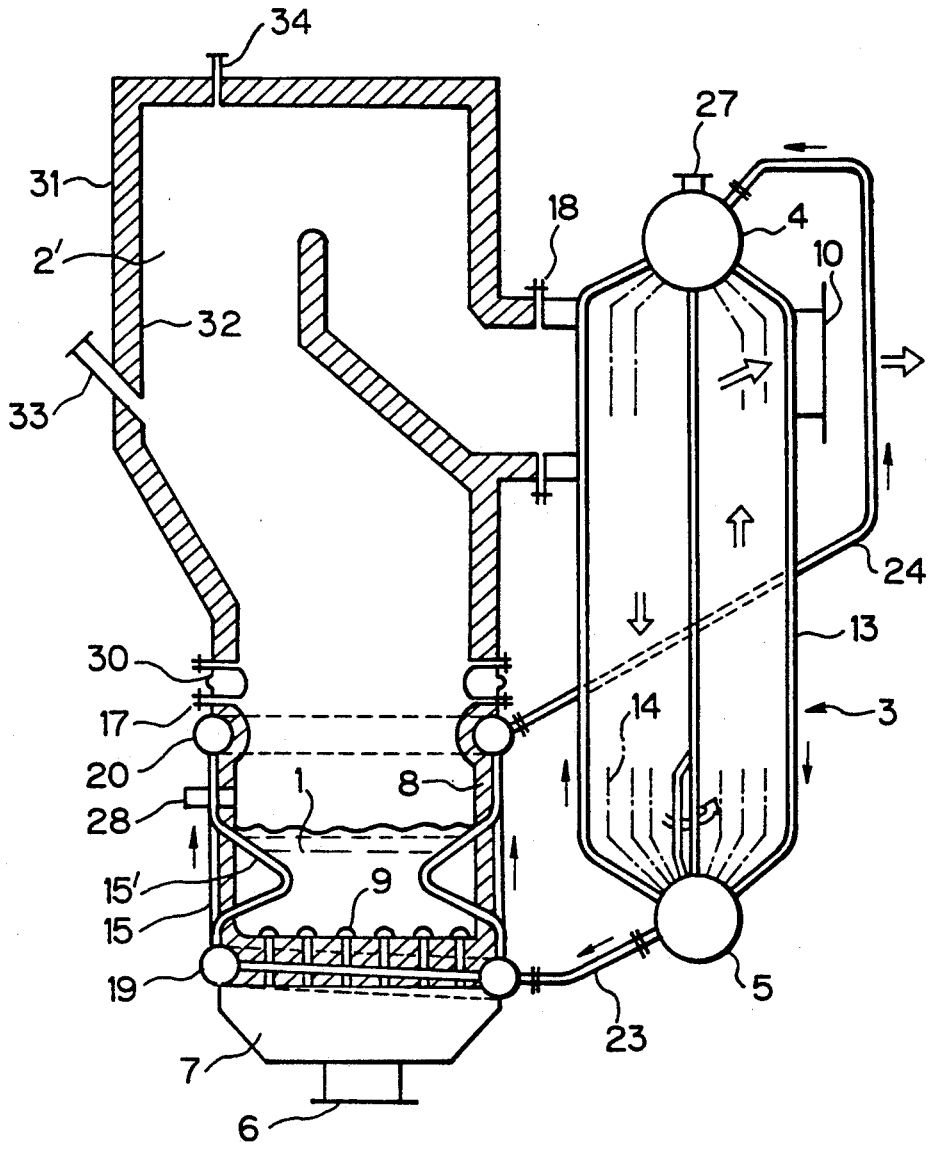
FIG. 2 is a vertical sectional view showing another embodiment of a fluidized bed water tube boiler of the present invention in which a freeboard section is made of steel plates covered with a refractory heat/insulating material.

A fluidized bed water tube boiler shown in FIG. 2 is obtained by removing the freeboard section 2 comprising the water tube wall, and the freeboard section water descending pipe 25 and the freeboard section ascending pipe 26 which are connected by bolt coupling at the respective flanges, all shown in FIG. 1, and attaching a freeboard section 2' by the use of flanges 17 and 18 and bolts. The freeboard section 2' is made of steel plates 31 and is protected at its inner surface by a refractory/heat insulating material 32. The remaining structure is the same as the fluidized bed water boiler shown in FIG. 1.

Additionally, in the embodiment shown in FIG. 2, the freeboard section 2' and the fluidized bed combustion section 1 are interconnected through an expansion 30 by bolt coupling at joint flanges provided above and below the expansion 30.

In the fluidized bed water tube boiler shown in FIG. 2, similarly to the fluidized bed water tube boiler shown in FIG. 1, fluidizing air is introduced to a air plenum 7 through a fluidizing air inlet 6 at the bottom of the boiler. Then, the air is blown into the fluidized bed combustion section 1 through fluidizing air dispersion nozzles 9, thereby fluidizing the fluidized bed and burning solid fuel supplied through a solid fuel supply port 28 in a fluidized state. Fuel powder not yet burnt and exiting the fluidized bed together with combustion gas, as well as combustible volatile components are further burnt in the freeboard section 2' with secondary air supplied through a secondary air nozzle 33.

Since the freeboard section 2' is constituted by the steel plates 31 and the refractory/heat insulating material 32, the flying-out fuel powder, etc. can be burnt at a high temperature of 900°–950° C., which is effective in reducing CO, $N_2O$ and dioxin. A water pouring port 34 may be provided at the top of the freeboard section for adjusting the temperature in the freeboard section. After having been fully burnt in the freeboard section, the combustion exhaust gas is introduced from the freeboard section to the convective heat transfer section 3 through a flue connected therebetween by the joint flanges 18.

The combustion exhaust gas is discharged to the outside through an exhaust gas outlet 10 after recovery of heat therefrom by way of the boiler water flowing through the convective heat transfer tubes 14 in the convective heat transfer section.

On the other hand, the boiler water is introduced from the water drum 5 to the lower header 19 by the descending water pipe 23, and then heated in the water tubes of the water tube wall 15 and the in-bed heat transfer tubes 15' to become a mixture of steam and water. The mixture rises through the water tubes and the in-bed heat transfer tubes to be collected together in the upper header 20, and is then introduced via the ascending pipe 24 to the steam drum 4 where the mixture is separated into steam and water. The steam is led to the outside through a main steam outlet 27, and the boiler water moves down through the rear wall tube 13 of the convective heat transfer section, and returns to the water drum 5. A natural circulation flow of boiler water is thus attained between the fluidized bed combustion section 1 and the convective heat transfer section 3.

In the convective heat transfer section 3, the boiler water having fallen down from the steam drum 4 to the water drum 5 through the rear wall tube 13 of the convective heat transfer section is heated into a mixed flow of steam and water while rising through the heat transfer tubes 14, and returns to the steam drum 4 to provide a natural circulation flow of boiler water.

Accordingly, although the freeboard section is formed from the steel plates and the refractory/heat insulating material, the natural circulation of the boiler water specific to the fluidized bed water tube boiler is maintained without being impaired at all.

In the fluidized bed water tube boiler shown in FIG. 2, the freeboard section has a structure completely independent of all other sections. Therefore, for example, even when it is desired to switch over fuel from one kind to another after starting up an operation to increase a residence time of the combustion gas in the freeboard section, i.e., even when it is desired to increase the volume of the freeboard section, the freeboard section can be easily replaced by another one having larger volume by removing the bolts from the joint flanges 17 and 18.

A fluidized bed water tube boiler modified from that shown in FIG. 2 will be next described with reference to FIG. 3.

Figure 3:
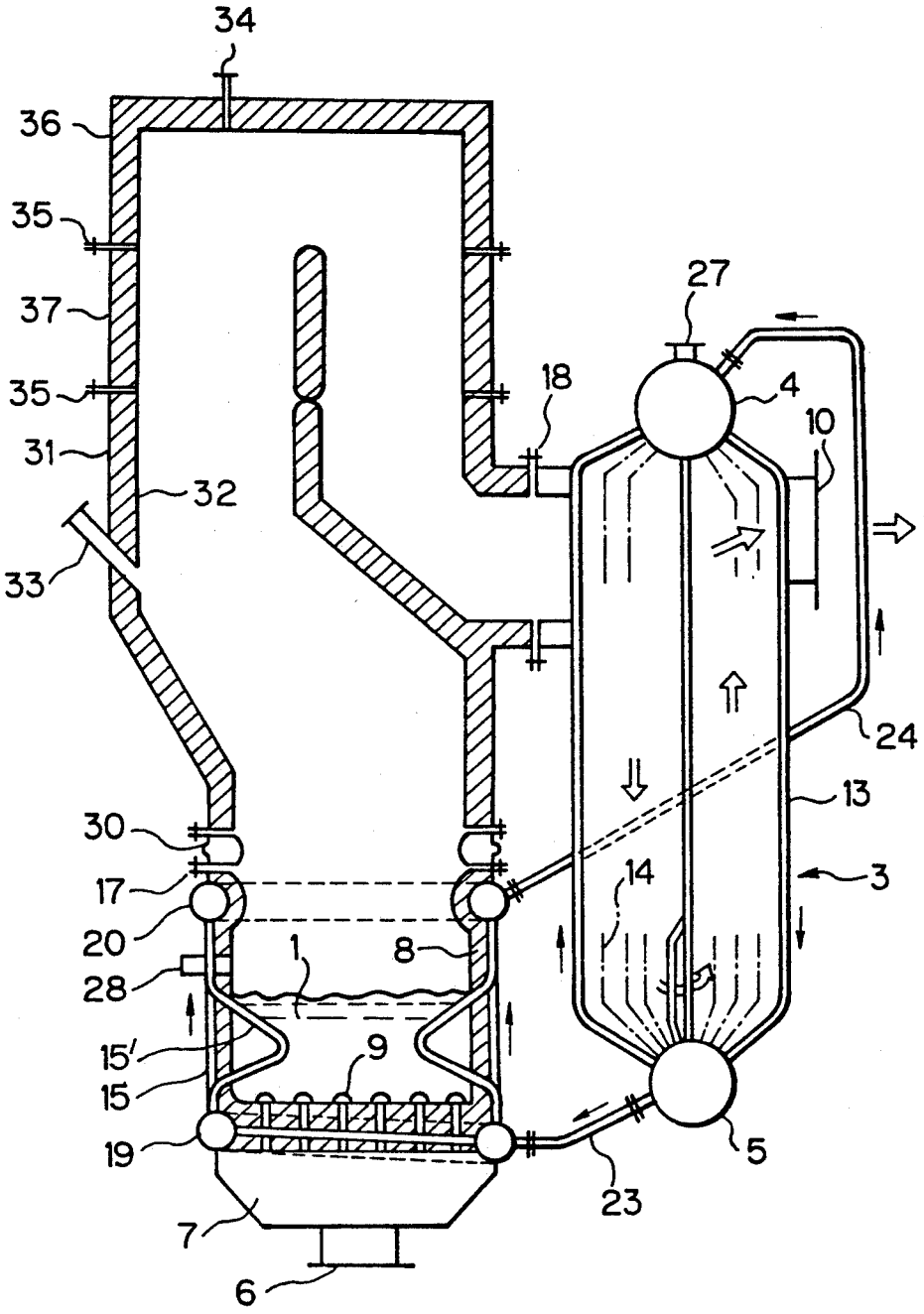
FIG. 3 is a vertical sectional view showing another embodiment having a freeboard section different from that of the fluidized bed water tube boiler shown in FIG. 2.

The fluidized bed water tube boiler shown in FIG. 3 is obtained by dividing the freeboard section of the fluidized bed water tube boiler shown in FIG. 2 into upper and lower parts at an intermediate portion, and providing dividing flanges 35 at their end portions. When it is desired to increase the volume of the freeboard section, this is realized by unfastening bolts from the flanges 35, removing an upper freeboard section 36, joining an additional freeboard section 37, placing the upper freeboard section 36 over the additional freeboard section 37, and finally bolting both the freeboard sections 36, 37 to the lower section via the flanges 35. Thus, the volume of the freeboard section can be easily increased.

Description will next be made with respect to a fluidized bed water tube boiler including a fluidized bed combustion section which has an inclined partition wall in a fluidized bed to provide a main fluidized bed chamber in which a swirling fluidized bed is formed and a heat recovery chamber in which a heat recovery bed is formed to recover heat from the fluidized bed, with references to FIGS. 4 to 7.

Figure 4:
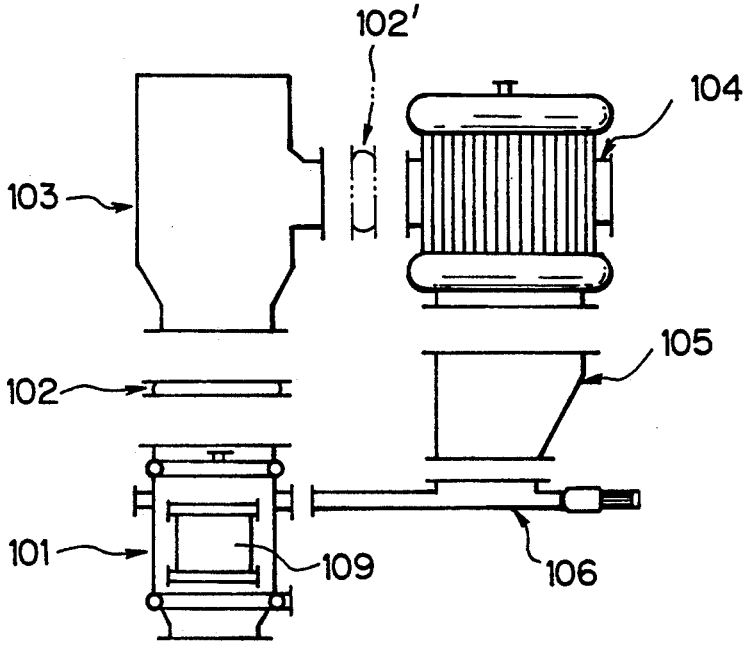
FIG. 4 is a side view showing a state that a fluidized bed water tube boiler is divided into a fluidized bed combustion section module, a freeboard section module and a convective heat transfer section module.

A fluidized bed water tube boiler shown in FIGS. 4 to 7 is basically divided into three modules, i.e., a fluidized bed combustion section 101, a freeboard 103, and a convective heat transfer section 104, as shown in FIG. 4. In addition, an expansion 102 is usually assembled between the fluidized bed combustion section 101 and the freeboard 103. Another expansion 102' may be similarly assembled between the freeboard 103 and the convective heat transfer section 104, but it is often omitted. In the embodiment shown in FIGS. 4 to 7, a chute 105 and transport means, e.g., a screw conveyor 106, for returning fly ash dropped into the convective heat transfer section 104 to the fluidized bed combustion section are additionally combined as auxiliary equipment.

Figure 5:
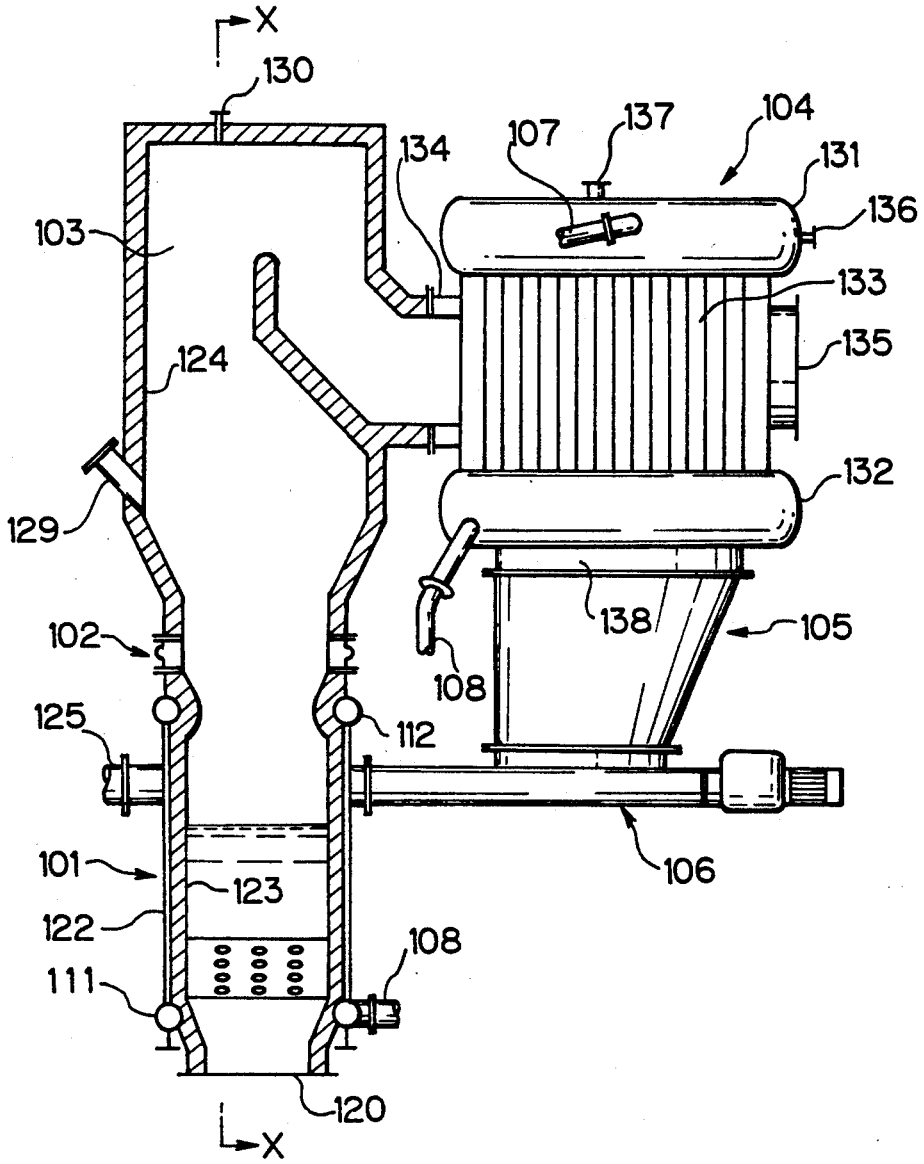
FIG. 5 is a side view for explaining one example of a fluidized bed water tube boiler of the present invention with only the fluidized bed combustion section and the freeboard section being vertically sectioned.
Figure 6:
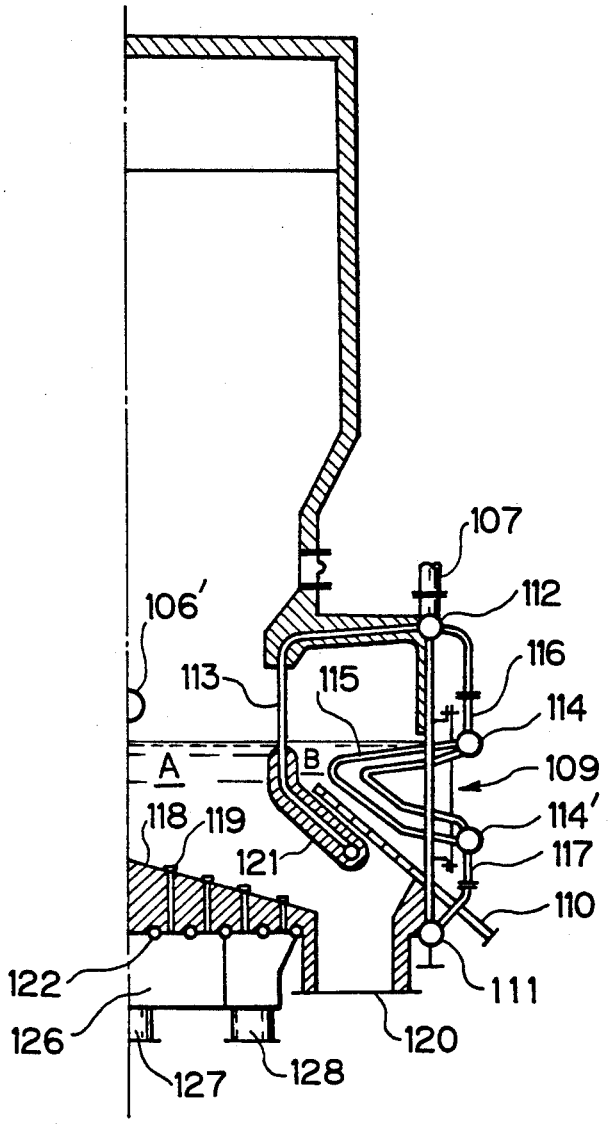
FIG. 6 is a view showing a right-hand half of the part of the fluidized bed combustion section and the freeboard section, as viewed from the front, corresponding to a sectional view taken along line X—X in FIG. 5.
Figure 7:
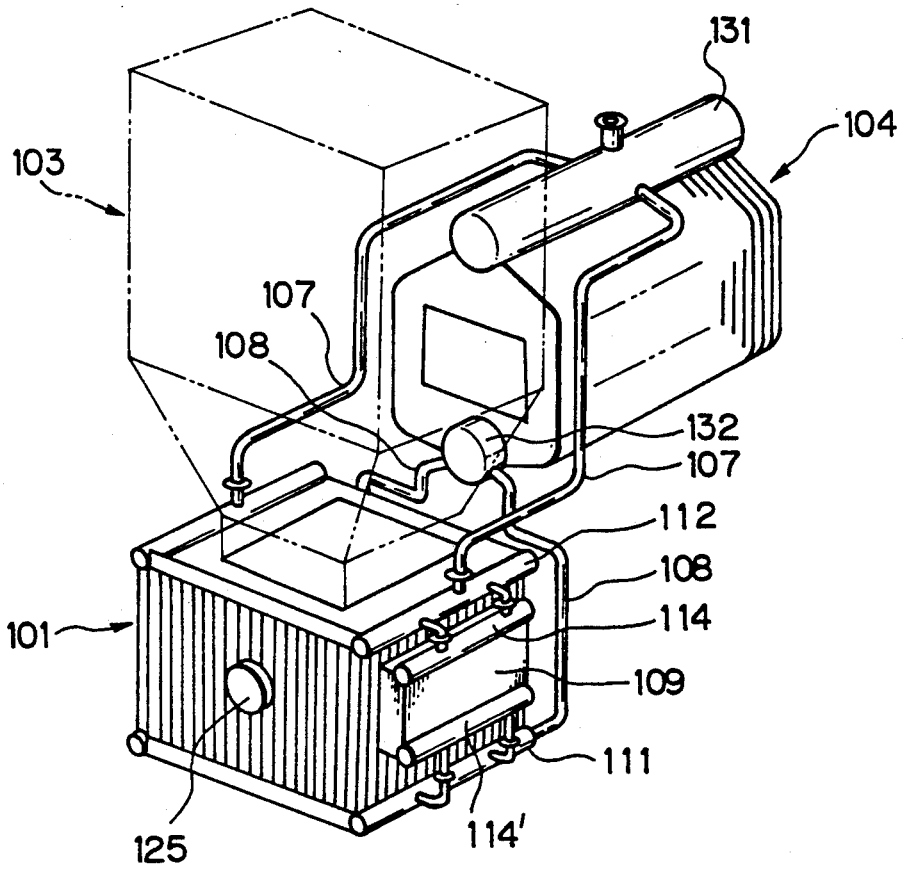
FIG. 7 is a perspective view of the fluidized bed water tube boiler, showing a state wherein the fluidized bed combustion section module, the freeboard section module, the convective heat transfer section module and so on, shown as divided in FIG. 4, are assembled.

The aforementioned fluidized bed water tube boiler will now be explained in detail by referring to FIGS. 5, 6 and 7.

Fluidized bed combustion section module

The fluidized bed combustion section 101 comprises a fluidized bed combustion section lower header 111, a fluidized bed combustion section upper header 112, and a fluidized bed combustion section water tube wall 122 interconnecting both the headers and surrounding the fluidized bed combustion section, with a large opening formed in its upper end to provide an exhaust gas passage. An inner surface of the fluidized bed combustion section 101 is lined with a refractory material 123. Further, discharge ports 120 are provided at both lateral end portions of the furnace bottom for extracting incombustible materials.

The furnace interior is divided into a heat recovery chamber B having a heat recovery chamber in-bed heat transfer tubes 115 arranged therein, and a main fluidized bed combustion chamber A in a central portion. These two chambers are partitioned by screen water tubes 113 (see FIG. 6) protruding into the furnace interior from the fluidized bed combustion section upper header 112. The screen water tubes 113 are bent at their lower portion so as to incline at an angle of 35°–45° with respect to the horizontal direction. A region of the screen water tubes 113 coming before and after the bent portion is covered with a refractory material 121. Thus, the screen water tubes 113 partition the fluidized bed combustion section into the main fluidized bed combustion chamber A and the heat recovery chamber B, and their inclined portions have an important role to serve as a deflector for converting the direction of movement of a fluidizing medium from an upward flow into a swirling flow toward the center. The fluidized bed combustion section lower header 111 and the fluidized bed combustion section upper header 112 are respectively communicated with a water drum 132 and a steam drum 131 of the convective heat transfer section module 104 by fluidized bed combustion section water descending pipe 108 (see FIGS. 5 and 7) and a fluidized bed combustion section ascending pipe 107 (see FIGS. 5, 6 and 7).

The main fluidized bed combustion chamber A has a air plenum 126 provided below the furnace bottom for forming a fluidized bed, the interior of the air plenum 126 being divided into three parts. Air is introduced to those three parts through fluidizing air inlets 127, 128. On the other hand, the air in the air plenum 126 is introduced to the furnace interior through air dispersing nozzles 119 for fluidizing a heat medium. The furnace bottom is protected by a refractory material 118. Also, for fluidizing the heat medium in the heat recovery chamber B, an air distributing pipe 110 is provided below the heat recovery chamber in-bed heat transfer tubes 115 so as to supply the fluidizing air out of the pipe 110 (see FIG. 6).

The water tube wall is additionally provided with a fuel supply pipe 125 and a recycled ash return port 106'.

Note that an operating method of the fluidized bed boiler including the swirling fluidized bed and the heat recovery chamber, as shown in FIGS. 4 to 7, is described in detail in Japanese Domestic Republication No. 1-800659.

Heat recovery chamber in-bed heat transfer tube unit

Meanwhile, the heat recovery chamber in-bed heat transfer tubes 115 are arranged in the heat recovery chamber B partitioned from the main fluidized bed chamber A. The heat transfer tubes 115 interconnect upper and lower headers 114, 114' to constitute a heat recovery chamber in-bed heat transfer tube unit 109. The upper header 114 of the unit 109 is communicated with the upper header 112 of the fluidized bed combustion section 101 by a connecting pipe 116, and the lower header 114' of the unit 109 is communicated with the lower header 111 of the fluidized bed combustion section 101 by a connecting pipe 117. As a result, the boiler water introduced from the water drum 132 of the convective heat transfer section module through the water descending pipe 108 is led through the connecting pipe 117 to the lower header 114' of the heat transfer tube unit 109 via the lower head 111 of the fluidized bed combustion section module 101, and is converted into a mixed flow of steam and water by being heated in the heat transfer tubes 115. Then, the mixed flow is collected together in the upper header 114 and is then returned to the steam drum 131 of the convective heat transfer section module 104 through the connecting pipe 116 and the upper head 112 of the fluidized bed combustion section module 101, thereby forming a natural circulating flow.

The connecting pipes 116, 117 are connected by bolt coupling at respective flanges so that the headers 114, 114' and the heat recovery chamber in-bed heat transfer tubes 115 can be removed together as the heat recovery chamber in-bed heat transfer tube unit 109.

Freeboard module

The freeboard module 103 is connected to the fluidized bed combustion section module 101 by bolt coupling at respective flanges via an expansion 102.

The freeboard module 103 is made of steel plates and its inner surface is lined with a refractory/heat insulating material 124. The freeboard module 103 is also provided with a plurality of secondary air nozzles 129 necessary for secondary combustion and, if necessary, with a water pouring port 130.

Convective heat transfer section module

The convective heat transfer section module 104 is provided downstream of the freeboard module 103 and is connected to a side opening of the module 103 by bolt coupling at respective flanges. At this joint portion, an expansion 102' (see FIG. 4) may be interposed. The convective heat transfer section module 104 comprises the steam drum 131, the water drum 132, and a group of water tubes 133 connecting those drums together. The exhaust gas introduced through the joint portion 134 from the freeboard module is subjected to heat recovery in the group of water tubes 133 and is then discharged to the outside through an exhaust gas outlet 135.

Boiler water is supplied through a nozzle 136 and generated steam is discharged to the outside through a main steam outlet 137. The steam drum 131 and the water drum 132 are respectively communicated with the fluidized bed combustion section module 101 by the fluidized bed combustion section ascending pipe 107 and the fluidized bed combustion section water descending pipe 108.

On the other hand, the boiler ash conveyor 106 is connected via the ash chute 105 to an ash discharge port 138 at the bottom of the convective heat transfer section module 104, the conveyor 106 having its exit end coupled to the recycled ash return port 106' of the fluidized bed combustion section module 101. Accordingly, fly ash or the like dropped in the convective heat transfer section module 104 can be returned to the fluidized bed combustion section module 101.

It is to be noted that any of the fluidized bed water tube boilers shown in FIGS. 1, 2 and 3 may have the fluidized bed combustion section modified to the swirling fluidized bed type described above with reference to FIGS. 4 to 7, and may be provided with the chute, the screw conveyor, the recycled ash return port, etc.

Since the fluidized bed water tube boiler of this invention is arranged as above, the invention has the following advantageous effects.

(1) Since the fluidized bed water tube boiler is constituted such that boiler water is independently circulated in each of the modules having different functions, i.e., a fluidized bed combustion section having in-bed heat transfer tubes or a heat recovery chamber, a freeboard section for burning volatile gas not yet burnt, etc., and a convective heat transfer section for recovering heat from combustion exhaust gas, it is possible to construct the fluidized bed combustion section, the freeboard section and, if desired, the convective heat transfer section as independent structures which can be separated and divided from one another. As a result, a change in fuels is possible even after starting up an operation. For example, in the present invention, when it is desired to increase a residence time in the freeboard section because of the existence of a large amount of a volatile component, the freeboard section can be replaced by another unit having a larger volume, in contrast to the prior art which requires the whole boiler to be replaced.

(2) Since the fluidized bed combustion section, the freeboard section and, if desired, the convective heat transfer section are independent structures which can be separated and divided from one another as mentioned above, one of the three modules can be formed to have no water tubes. In other words, it is possible to form only the freeboard section from steel plates and a refractory/heat insulating material and hence to produce a higher temperature in the freeboard section, which contributes to a reduction in CO, $N_2O$ and dioxin emissions. Further, the structure having no water tubes eliminates the need to consider water circulation, thus enabling the freeboard section to have an optimum structure for combustion.

(3) Since the fluidized bed water tube boiler is functionally divided into two or more modules, i.e., the fluidized bed combustion section having in-bed heat transfer tubes, the freeboard section for burning volatile gas not yet burnt, etc., and, if desired, the convective heat transfer section for recovering heat from combustion exhaust gas, various combustibles having different degrees of combustibility, such as coal, municipal refuse and industrial waste, for each of which new design has been required in the prior art, can be effectively dealt with according to the present invention by selecting optimum modules of the fluidized bed combustion section, the freeboard section and the convective heat transfer section among respective groups of standard modules and combining them with one another, taking into account the degree of a combustibility of a target fuel. Therefore, no new design is necessary for a new kind of fuel, which contributes to a reduction in costs and an increase in efficiency.

(4) Division into modules makes it possible to easily standardize design and manufacture, as well as to cut down on manufacturing costs.

(5) Because of the division into modules, each module can be solely manufactured in a factory. Thus, up to those classes of boilers having a steam level of 20–30 T/H, separate modules formed in final products can be transported to the site and assembled there. Thus, as compared with the prior art which required the boiler to be built by welding individual parts on site, installation work can be greatly simplified and cost reduced.

What is claimed is:

1. A fluidized bed water tube boiler comprising a fluidized bed combustion section including a fluidized bed formed from a continuous water tube wall, a freeboard section for burning volatile components produced in said fluidized bed combustion section, and a convective heat transfer section comprised of a steam drum and a water drum connected to the downstream side of said freeboard section through water tubes for recovering heat from combustion exhaust gas; said boiler being characterized in that said fluidized bed combustion section and said freeboard section are formed as separable modules which are connected to each other, and circulation of a boiler water between said fluidized bed combustion section and said convective heat transfer section is separated from that between said freeboard section and said convective heat transfer section.

2. A fluidized bed water tube boiler according to claim 1, wherein two collective headers comprising a freeboard section lower header and a fluidized bed combustion section upper header are provided so as to surround said water tube wall near the boundary between said fluidized bed combustion section and said freeboard section, said fluidized bed combustion section and said freeboard section being separable between said two headers, and said fluidized bed combustion section module is constituted such that said fluidized bed combustion section upper header and a fluidized bed combustion section lower header provided so as to surround a lower portion of said fluidized bed are communicated with each other by a group of water tubes to form said wall of said fluidized bed combustion section.

3. A fluidized bed water tube boiler comprising a fluidized bed combustion section including a fluidized bed formed from a continuous water tube wall, a freeboard section for burning volatile components produced in said fluidized bed combustion section, and a convective heat transfer section including a steam drum and a water drum connected to the downstream side of said freeboard section through water tubes for recovering heat from combustion exhaust gas; said boiler being characterized in that two collective headers comprising a freeboard section lower header and a fluidized bed combustion section upper header are provided so as to surround said water tube wall near the boundary between said fluidized bed combustion section and said freeboard section, said fluidized bed combustion section and said freeboard section being separable between said two headers, said fluidized bed combustion section is formed as a module which is constituted such that said fluidized bed combustion section upper header and a fluidized bed combustion section lower header provided so as to surround a lower portion of said fluidized bed are communicated with each other by a group of water tubes to form said wall of said fluidized bed combustion section, said freeboard section is formed as a module which is constituted such that said freeboard section lower header and a freeboard section upper header provided in an upper portion of said freeboard section are communicated with each other by a group of water tubes to form a wall of said freeboard section, and said freeboard section is separable from said convective heat transfer section, whereby said boiler is divided into three modules of said fluidized bed combustion section, said freeboard section and said convective heat transfer section.

4. A fluidized bed water tube boiler according to claim 3, wherein said freeboard section can be separated from said convective heat transfer section at a flue connecting said freeboard section and said convective heat transfer section.

5. A fluidized bed water tube boiler according to claim 3, wherein said convective heat transfer section module is formed from a boiler of natural circulation type wherein said steam drum and said water drum are interconnected by water tubes.

6. A fluidized bed water tube boiler according to claim 5, wherein said steam drum and said water drum are connectable to said fluidized bed combustion section upper header and said fluidized bed combustion section lower header by a fluidized bed combustion section ascending pipe and a fluidized bed combustion section water descending pipe, respectively, and said steam drum and a lower portion of said steam drum or said water drum are connectable to said freeboard section upper header and said freeboard section lower header by a freeboard section ascending pipe and a freeboard section water descending pipe, respectively.

7. A fluidized bed water tube boiler comprising three divided modules including a fluidized bed combustion section module forming a fluidized bed, a freeboard section module for burning volatile components produced in said fluidized bed, and a convective heat transfer section module for recovering heat from combustion gas; said boiler being characterized in that said fluidized bed combustion section module is constituted such that a fluidized bed combustion section upper header and a fluidized bed combustion section lower header provided so as to surround upper and lower portions of said fluidized bed combustion section, respectively, are communicated with each other by a group of water tubes, said group of water tubes forming a wall of said fluidized bed combustion section, and said freeboard section module is formed from steel plates, a refractory material and a heat insulating material for maintaining a high temperature in said freeboard section.

8. A fluidized bed water tube boiler according to claim 7, wherein said convective heat transfer section module is formed from a boiler of a natural circulation type wherein a steam drum and a water drum are interconnected by water tubes.

9. A fluidized bed water tube boiler according to claim 8, wherein said steam drum and a lower portion of said steam drum or said water drum are connectable to said fluidized bed combustion section upper header and said fluidized bed combustion section lower header by an ascending pipe and a descending pipe, respectively.

10. A fluidized bed water tube boiler comprising three divided modules including a fluidized bed combustion section module comprised of a main fluidizing chamber forming a main fluidized bed to burn solid substances and a heat recovery chamber forming a heat recovery bed to recover heat from said main fluidized bed, a freeboard section module for burning volatile components produced in said main fluidized bed, and a convective heat transfer section module for recovering heat from combustion gas; said boiler being characterized in that said fluidized bed combustion section module is constituted by an upper header, a lower header and a water tube wall interconnecting both said headers, each header having the square form, and those water tubes of said water tube wall which are positioned in the left and right sides as viewed from the front of said boiler are constituted by groups of water tubes alternately protruding inwardly to greater and lesser extents respectively, said former group of water tubes being protected at their lower surfaces by a refractory material to define said main fluidizing chamber and said heat recovery chamber and also serving as a deflector adapted to change a fluidizing direction of a heat medium in said main fluidized bed, and said latter group of water tubes serving as heat recovery chamber in-bed heat transfer tubes of natural circulation type to recover heat from said heat recovery bed.

11. A fluidized bed water tube boiler according to claim 10, wherein said freeboard section module is formed from steel plates, a refractory material and a heat insulating material for maintaining a high temperature in said freeboard section.

12. A fluidized bed water tube boiler according to claim 10, wherein said convective heat transfer section module is formed from a boiler of a natural circulation type comprising a steam drum, a water drum and water tubes, said steam drum and said water drum being connectable to an upper header and a lower header of said fluidized bed combustion section module by an ascending pipe and a descending pipe, respectively.

13. A fluidized bed water tube boiler according to claim 7, wherein said freeboard section has a horizontal dividing plane provided in its intermediate portion and can be joined to another freeboard unit at said intermediate horizontal dividing plane.

14. A fluidized bed water tube boiler according to claim 10, wherein said fluidized bed combustion section module is constituted such that aside from said water tube wall, said group of heat recovery chamber in-bed heat transfer tubes are grouped into a plurality of independent units each connected to an upper header and a lower header, said units being inserted into said heat recovery bed from a lateral surface of said fluidized bed combustion section, and said upper and lower headers of each of said units are respectively connected to said upper and lower headers of said fluidized bed combustion section module through tubes to thereby constitute said heat recovery chamber in-bed heat transfer tubes of a natural circulation type, said units being detachably attached to said fluidized bed combustion section module.

15. A fluidized bed water tube boiler according to claim 10, wherein for returning fly ash or the like captured in said convective heat transfer section module to said fluidized bed combustion section module, transport equipment is provided below said convective heat transfer section module and has its distal end coupled to said fluidized bed combustion section module.

16. A fluidized bed water tube boiler according to claim 10, wherein said freeboard section has a horizontal dividing plane provided in its intermediate portion and can be joined to another freeboard unit at said intermediate horizontal dividing plane.

17. A fluidized bed water tube boiler according to claim 11, wherein for returning fly ash or the like captured in said convective heat transfer section module to said fluidized bed combustion section module, transport equipment is provided below said convective heat transfer section module and has its distal end coupled to said fluidized bed combustion section module.

18. A fluidized bed water tube boiler according to claim 12, wherein for returning fly ash or the like captured in said convective heat transfer section module to said fluidized bed combustion section module, transport equipment is provided below said convective heat transfer section module and has its distal end coupled to said fluidized bed combustion section module.

19. A fluidized bed water tube boiler according to claim 13, wherein for returning fly ash or the like captured in said convective heat transfer section module to said fluidized bed combustion section module, transport equipment is provided below said convective heat transfer section module and has its distal end coupled to said fluidized bed combustion section module.

20. A fluidized bed water tube boiler according to claim 14, wherein for returning fly ash or the like captured in said convective heat transfer section module to said fluidized bed combustion section module, transport equipment is provided below said convective heat transfer section module and has its distal end coupled to said fluidized bed combustion section module.

21. A fluidized bed water tube boiler according to claim 16, wherein for returning fly ash or the like captured in said convective heat transfer section module to said fluidized bed combustion section module, transport equipment is provided below said convective heat transfer section module and has its distal end coupled to said fluidized bed combustion section module.

* * * * *